US011842892B2

(12) United States Patent
Belov et al.

(10) Patent No.: US 11,842,892 B2
(45) **Date of Patent: *Dec. 12, 2023**

(54) ION INJECTION TO AN ELECTROSTATIC TRAP

(71) Applicant: Thermo Fisher Scientific (Bremen) GmbH, Bremen (DE)

(72) Inventors: Mikhail Belov, Bremen (DE); Eduard Denisov, Bremen (DE); Gregor Quiring, Hamburg (DE); Dmitry Grinfeld, Bremen (DE)

(73) Assignee: Thermo Fisher Scientific (Bremen) GmbH, Bremen (DE)

( * ) Notice: Subject to any disclaimer, the term of this patent is extended or adjusted under 35 U.S.C. 154(b) by 0 days.

This patent is subject to a terminal disclaimer.

(21) Appl. No.: 17/724,219

(22) Filed: Apr. 19, 2022

(65) Prior Publication Data

US 2022/0238321 A1 Jul. 28, 2022

Related U.S. Application Data

(63) Continuation of application No. 15/600,996, filed on May 22, 2017, now Pat. No. 11,328,922.

(30) Foreign Application Priority Data

May 23, 2016 (GB) ..... 1609022

(51) Int. Cl.

| | |
|---|---|
| ***H01J 49/00*** | (2006.01) |
| ***H01J 49/42*** | (2006.01) |
| ***H01J 49/06*** | (2006.01) |

(52) U.S. Cl.

CPC ..... *H01J 49/4245* (2013.01); *H01J 49/061* (2013.01); *H01J 49/063* (2013.01); *H01J 49/4295* (2013.01)

(58) Field of Classification Search

CPC ..... H01J 49/00; H01J 49/02; H01J 49/4245; H01J 49/061; H01J 49/063; H01J 49/4295; H01J 49/425; H01J 49/426; H01J 49/0031; H01J 49/06; H01J 49/062

USPC ..... 250/281, 282, 283

See application file for complete search history.

(56) References Cited

U.S. PATENT DOCUMENTS

| | | | | |
|---|---|---|---|---|
| 11,328,922 | B2 * | 5/2022 | Belov | H01J 49/4295 |
| 2004/0108450 | A1 * | 6/2004 | Makarov | B82Y 30/00 250/281 |
| 2007/0057172 | A1 * | 3/2007 | Wang | H01J 49/062 250/281 |

(Continued)

*Primary Examiner* — Jason L McCormack

(57) ABSTRACT

Ions are injected into an orbital electrostatic trap. An ejection potential is applied to an ion storage device, to cause ions stored in the ion storage device to be ejected towards the orbital electrostatic trap. Synchronous injection potentials are applied to a central electrode of the orbital electrostatic trap and a deflector electrode associated with the orbital electrostatic trap, to cause the ions ejected from the ion storage device to be captured by the electrostatic trap such that they orbit the central electrode. Application of the ejection potential and application of the synchronous injection potentials are each started at respective different times, the difference in times being selected based on desired values of mass-to-charge ratios of ions to be captured by the orbital electrostatic trap.

28 Claims, 6 Drawing Sheets

(56) References Cited

U.S. PATENT DOCUMENTS

2014/0224981 A1* 8/2014 Owen ..... H01J 49/004
250/288

* cited by examiner

ION INJECTION TO AN ELECTROSTATIC TRAP

CROSS-REFERENCE TO RELATED APPLICATIONS

The present application is a continuation under 35 U.S.C. § 120 and claims the priority benefit of co-pending U.S. patent application Ser. No. 15/600,996, filed May 22, 2017. The disclosure of the foregoing application is incorporated herein by reference.

TECHNICAL FIELD OF THE INVENTION

The invention relates to a method of injecting ions into an electrostatic trap from an ion storage device and a corresponding mass spectrometer.

BACKGROUND TO THE INVENTION

The use of electrostatic traps as mass analyzers, such as the orbital trapping mass analyzer (marketed under the name Orbitrap™), has provided high resolution mass spectra with a high dynamic range. This type of mass spectrometry, particularly utilizing the orbital trapping mass analyzer, is increasingly used for detection of small organic molecules as well as large intact proteins and native protein complexes.

The intrinsic capability of this type of mass analyzer to trap molecular species at the extremes of broader mass-to-charge (m/z) ratio ranges may depend on the quality of ion injection into the electrostatic trap. To assist with understanding the injection process, it is useful to consider how an existing mass analyzer of this type is operated.

Referring to FIG. 1, there is depicted a schematic of a known mass spectrometer using an orbital trapping mass analyzer. This mass spectrometer is marketed under the name Exactive Plus™ by Thermo Fisher Scientific. The mass spectrometer comprises: an Atmospheric Pressure Ionization ion source 10; source injection optics 20; a bent flatapole ion guide 30; a transfer multipole ion optical device 40; a curved linear trap (CLT or C-trap) 50; a Z-lens 60; an orbital trapping mass analyzer 70; a Higher-Energy Collision Dissociation (HCD) collision cell 80; and a collector 90. The source injection optics 20 comprises: a capillary 21; a S-lens 22; a S-lens exit lens 23; an injection flatapole ion optical device 24; and an inter-flatapole lens 25. Also provided are: a flatapole exit lens 35; a split lens 36; a C-trap entrance lens 53; and a C-trap exit lens 55.

As is well-known, the orbital trapping mass analyzer 70 is axially-symmetrical and comprises a spindle-shape central electrode (CE) 72 surrounded by a pair of bell-shaped outer electrodes 75. Electric fields within the mass analyzer are used to capture and confine ions therein such that trapped ions undergo repeated oscillations in an axial direction of the analyzer whilst orbiting about the central electrode. A deflector electrode 65 is provided adjacent the entrance aperture to the orbital trapping mass analyzer 70 to deflect ions into the entrance. Ions are injected into the orbital trapping mass analyzer 70 from the CLT 50 at high energies (typically 1-2 keV per charge) to achieve dynamic trapping. If injection takes place over hundreds of microseconds at such energies, the process may last for hundreds of ion reflections. Without any collisional cooling outside of the electrostatic trap, ion stability may be compromised. To enable efficient ion trapping, a temporal spread of an ion packet in the vicinity of the injection slot should be shorter than a half period of axial ion oscillation in the electrostatic trap. Therefore, a short injection time is used, which creates tight requirements for ion capture. Although the mass analyzer in this example is of an orbital trapping type, similar considerations apply to the injection of ions into other electrostatic traps, which often have strict requirements for ion injection and capture.

In the example shown in FIG. 1, injection to the orbital trapping mass analyzer 70 involves the C-trap 50. Ions for analysis are ejected from the C-trap 50 in a direction orthogonal to the direction in which they enter the C-trap 50 from the transfer multipole ion optical device 40. This is effected by ramping off an RF potential applied to the rods of the C-Trap and applying extracting voltage pulses to the electrodes. The initial curvature of the C-Trap 50 and the subsequent lenses, such as Z-lens 60, cause the ion beam to converge on the entrance to the orbital trapping mass analyzer 70. The Z-lens 60 also provides differential pumping slots (electrostatically deflecting the ions away from the gas jet, thereby eliminating gas carryover into the analyzer) and causes spatial focusing of the ion beam into the entrance of the orbital trapping mass analyzer 70.

The fast pulsing of ions from the C-Trap 50 causes ions of each mass-to-charge ratio to arrive at the entrance of the orbital trapping mass analyzer 70 as short packets only a few millimeters long. For ions of each mass-to-charge species, this corresponds to a spread of flight times of only a few hundred nanoseconds for mass-to-charge ratios of a few hundred Daltons per charge. Such durations are considerably shorter than a half-period of axial ion oscillation in the electrostatic trap 70. When ions are injected into the orbital trapping mass analyzer 70 at a position offset from its equator, these packets start coherent axial oscillations without the need for any additional excitation cycle.

Injection may also rely on dynamic waveforms applied to the deflector electrode 65 and the CE 72 during an injection event. Collectively, these can be referred to as CE Injection Waveforms. The ion species entering the analyzer during an injection event experience a dynamic electric field inside the trapping region (between the CE 72 and outer electrodes 75) and concurrently orbit the CE 72 with a decreasing radius during several initial periods of axial oscillation. This is the process known as dynamic squeezing. Upon injection, the potential applied to the CE 72 is varied in a ramped manner, for example made more negative for the trapping of positive ions and made more positive for the trapping of negative ions. This dynamic potential at the CE reduces the ions' radial position in the trapping region during an injection event and results in ion trapping and subsequent detection within the electrostatic trap.

A detailed discussion of this injection is also provided in International Patent Publication No. WO-02/078046 and the contents of this document are incorporated herein by reference. For the mass spectrometer shown in FIG. 1, detection of ions having a m/z ratio between 50 Thomsons (Th, equivalent to Daltons per elementary electrical charge) and 6000 Th is routinely possible. Improving (and where possible, optimizing) the range of m/z ratios that can be readily detected is desirable. Achieving such improvements remains a challenge, however.

SUMMARY OF THE INVENTION

Against this background, there is provided a method of injecting ions into an electrostatic trap in line with claim 1 and a mass spectrometer as defined in claim 22. Further features of the invention are detailed in the dependent claims. The mass spectrometer is operable to perform mass analysis of ions that have been captured in the electrostatic trap by the method of injecting ions. An injection event comprises two main parts: (a) applying an ejection potential to an ion storage device; and (b) applying one or more injection potentials to an electrode, which may be associated with the electrostatic trap (preferably, the electrostatic trap is of an orbital trapping type). The ejection potential causes ions stored in the ion storage device to be ejected towards the electrostatic trap. The one or more injection potentials cause the ions ejected from the ion storage device to be captured by the electrostatic trap. In particular, synchronous injection potentials of different amplitudes may be applied concurrently to the multiple electrodes associated with the electrostatic trap (such as a deflector and central electrode). The ion storage device is beneficially a linear ion trap and preferably a curved linear trap (termed CLT or C-trap), especially when an orbital trapping type electrostatic trap is used.

Conventionally, (a) and (b) have been started at the same time. Advantageously, the present invention starts (a) and (b) at different times. The start times (or at least, the difference between the start times, in terms of direction and/or magnitude) are beneficially selected based on desired values of mass-to-charge ratios of ions to be captured by the electrostatic trap (which may be covered by one or multiple ranges of mass-to-charge ratios). In other words, to capture ions that include those having a specific range of mass-to-charge ratios, either: (a) may be started before (b); or (b) may be started before (a), and the selection from these two options depends on the specific range of mass-to-charge ratios. In another sense, the length of time between the start of (a) and the start of (b) may depend on the specific range of mass-to-charge ratios.

By the use of this technique detection of ions having m/z ratios as low as 35 Th or as high as 20000 Th (or higher) is possible, which is a significantly wider range than for the existing mode of operation, with improvements at both ends of the range. Moreover, the m/z range of the mass spectrometer can be advantageously tuned for optimized ion detection. In this way, the ratio of highest and lower m/z ratios in a spectrum can be as high as 40:1 and possibly higher. For example, a mass spectrum may be generated based on multiple "micro-scans" in the electrostatic trap, that is from respective multiple ion injections into the electrostatic trap, taken at different delay times between the ejection and injection potentials, in order to achieve a higher range of m/z ratios. In other words, each scan is based on a different delay time and provides a mass spectrum of ions of a different range of m/z ratios. A sum of such spectra thereby provides a "composite" mass spectrum of a higher range of m/z ratios than each individual scan.

It has been discovered that, where the desired range of mass-to-charge ratios of ions to be captured by the electrostatic trap covers a range lower than a threshold mass-to-charge ratio (for instance, around 100 Thomsons), (b) should beneficially start before (a). The duration (magnitude) of this time difference may be at least that of an induction (settling) time period associated with the one or more injection potentials. The induction period may be around 1 μs, so (b) may start around 3 μs before (a). Preferably, (b) may start before (a) with a time difference of between 1 μs to 5 μs, 2 μs to 4 μs or about 3 μs.

In contrast, if the desired range of mass-to-charge ratios of ions to be captured by the electrostatic trap covers a range higher than a limit mass-to-charge ratio (about 8000 Thomsons, for example), (a) should advantageously start before (b). That is, the start of applying the one or more injection potentials is delayed with respect to the start of the ejection potential being applied. The duration of this time difference may be based on one or more of: a time period associated with the ejection potential; a time period associated with the one or more injection potentials; and a time period associated with a flight time for ions between the ion storage device and the electrostatic trap, especially a flight time for ions having a mass-to-charge ratio of at least the limit mass-to-charge ratio. In particular, the time difference may be greater than the flight time for ions between the ion storage device and the electrostatic trap but less than the sum of the flight time for ions between the ion storage device and the electrostatic trap (typically, at least 15 μs for ions of about m/z 8,000 and higher) and the discharge time constant associated with the one or more injection potentials (around 10 μs, for instance). Therefore, a time difference of between 15-25 μs, for example about 20 μs, may be used in practice. However, longer delays of (b) after (a) might be employed for trapping the highest m/z ions, for example time differences between 25 and 50 μs.

For example, where the electrostatic trap is of an orbital trapping type, it comprises a central electrode and a co-axial outer electrode. The co-axial outer electrode usually comprises a pair of bell-shaped outer electrodes. Then, the step of applying one or more injection potentials may comprise applying a trapping injection potential to the central electrode and/or the deflector. This may be a ramping potential from a first injection potential level to a second, lower injection potential level. The second potential level may be a zero potential. For trapping positive ions, the trapping injection potential to the central electrode is preferably a ramping potential that changes from a first negative potential level to a lower (that is, more negative) potential level. For example, the first potential level may be in the range from −3.2 kV to −3.7 kV and the second lower potential may be about −5 kV. For trapping negative ions, these polarities would be reversed (that is, applying positive potentials to the central electrode). The second potential level is preferably the final potential applied to the central electrode: that is, the potential applied to the electrode during detection of the ions in the electrostatic trap following the injection process. The duration of the potential ramp on the central electrode from the first to the second potential level can be in the range 5 μs to 200 μs, such as 5 μs to 100 μs, but preferably 5 μs to 50 μs.

The ejection potential may be applied by reducing a magnitude of a potential applied to an electrode of the ion storage device, such that the ions stored in the ion storage device are ejected towards the electrostatic trap. Reducing a magnitude of a potential applied to an electrode of the ion storage device beneficially comprises switching off the potential, such as an RF potential applied to one or more electrodes of the ion storage device, for example an RF potential applied to multipole rod electrodes. The ejection potential may be alternatively, or preferably additionally, applied by applying an extraction potential to one or electrodes of the ion storage device, preferably in the form of one or more DC potentials applied to one or more electrodes. In one embodiment, opposite polarity DC potentials can be applied to at least two electrodes of the ion storage device providing a push and pull of the ions in the ion storage device to eject them from the device. The duration of the ejection potential applied to the ion storage device may be in the range 5 μs to 40 μs, preferably 10 μs to 20 μs.

The one or more injection potentials may comprise a deflecting injection potential, applied to an ion deflector between the ion storage device and the electrostatic trap. This may cause the ions to travel towards (and/or be focused on an entrance aperture of) the electrostatic trap. Additionally or alternatively, the one or more injection potentials may comprise a trapping injection potential applied to an electrode of the electrostatic trap.

In embodiments where the electrostatic trap is an orbital trapping electrostatic trap, the trapping injection potential can be applied to a central electrode of the electrostatic trap about which the captured ions orbit. Application of the trapping injection potential and deflecting injection potential may be started at the same time. This is beneficial from the perspective of simplicity. Where they are not started at the same time, the time difference with respect to applying the ejection potential refers to the first to start of the trapping injection potential and deflecting injection potential.

BRIEF DESCRIPTION OF THE DRAWINGS

The invention may be put into practice in a number of ways, and a preferred embodiment will now be described by way of example only and with reference to the accompanying drawings, in which.

DETAILED DESCRIPTION OF A PREFERRED EMBODIMENT

Figure 1:
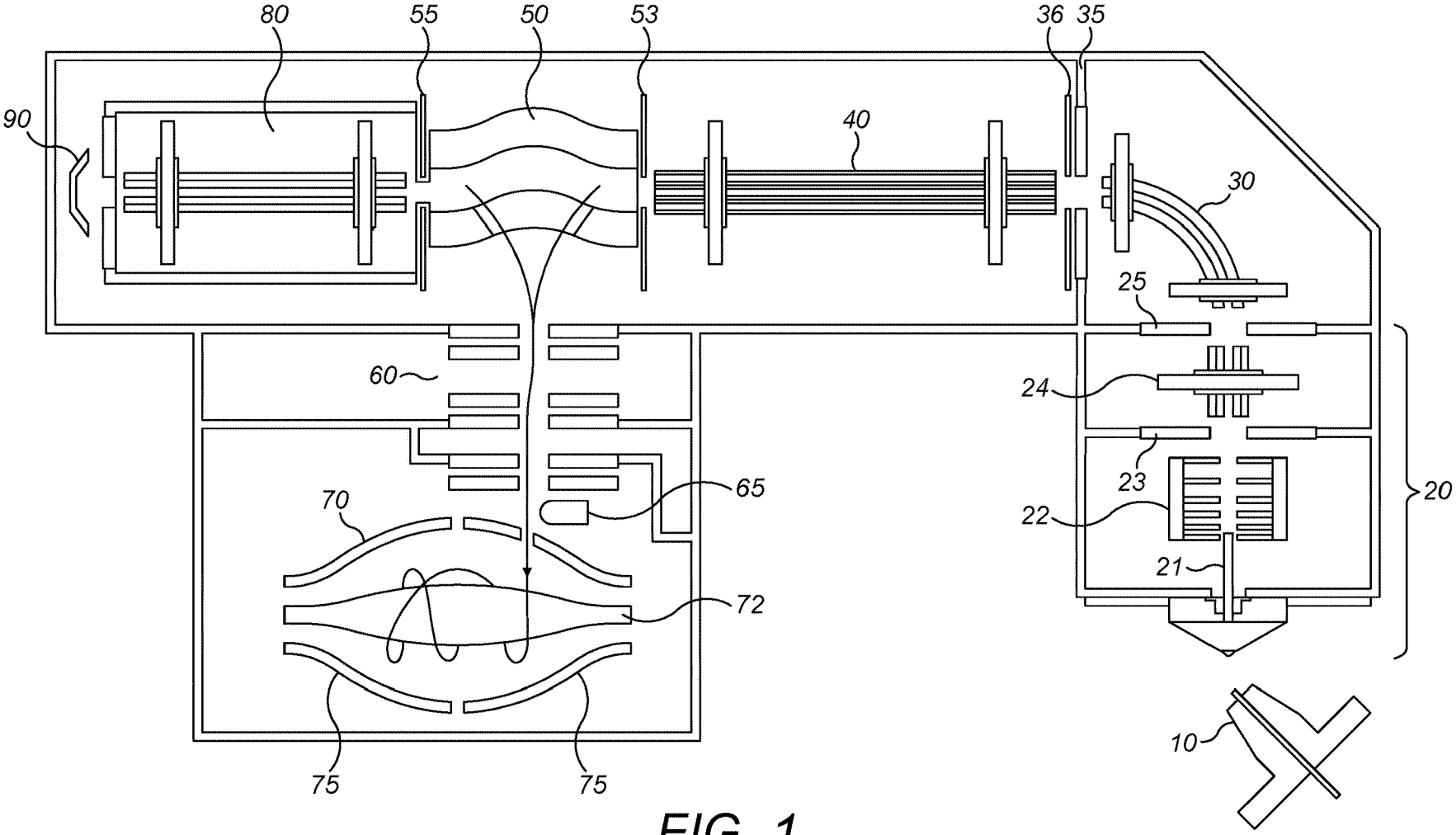
FIG. 1 depicts a schematic of a known mass spectrometer using an orbital trapping mass analyzer.

The discussion below references the known mass spectrometer depicted in FIG. 1. Nevertheless, it will be understood that the techniques described herein are applicable to a wide range of other mass spectrometers, which may use different types of mass analyzer and different ways to inject ions into the mass analyzer. The approaches described herein are especially applicable to electrostatic traps with upstream ion storage, such that injection from the ion storage device to the electrostatic trap involves ejection from the ion storage device. The invention may find application in embodiments where there is a difference in the time of arrival of ions at the electrostatic trap after ejection from the ion storage device that depends on the m/z of the ions. The invention may additionally (or alternatively) find application in embodiments where there is an induction (settling) time period associated with the one or more injection potentials.

It has been discovered that the conventional parameters of ion ejection from the C-Trap 50 to the orbital trapping mass analyzer 70 may cause loss of ions of low mass-to-charge (m/z) ratio and/or high m/z ratio. This may occur for different reasons, as will now be explained.

One reason why ions of high m/z ratio may be lost is as follows. Modelling has allowed determination of the flight times of ions of a given m/z ratio from the C-Trap 50 to the entrance port of the orbital trapping mass analyzer 70. As explained above, ions are ejected from the C-Trap 50 by reducing the RF potential applied to its rod electrodes and applying an extraction voltage pulse (typically push and pull voltages applied to respective electrodes of the C-Trap 50). The modelling has shown that following such ejection (a purge event), ions of higher m/z ratio, such as those with an m/z ratio of 8,000 or greater, arrive at the electrostatic trap entrance in approximately 15 μs.

The dynamic Central Electrode (CE) injection waveforms, conventionally starting at the same time as the ejection potentials for the C-trap ejection event, result in a reduced potential on the CE 72 and therefore a reducing field strength is applied to the CE 72 during injection to provide for the trapping of ions (concurrently an increasing dynamic potential is applied to the deflector electrode 65). For positive ions, an increasing deflector voltage as a function of time may steer ions into the injection slot and a lower voltage (more negative voltage) is applied to the CE 72 to reduce the ions' orbital radius during injection. The increasing voltage on the deflector may compensate the effect of negative field sagging into the deflector region, so that the deflection field at the injection point remains nearly constant and independent of the time-varying negative potential applied to the CE 72. The reducing field strength means that the ions with high m/z ratio, arriving into the electrostatic trap later than the low m/z ions, experience a field from the potential on the CE 72 that is already significantly reduced in amplitude. Hence, the remaining dynamic field that can be used for trapping these higher m/z ions is reduced. The efficiency of trapping such ions is therefore reduced, since a dynamic field is required for trapping ions in the electrostatic trap.

In the case of an orbital trapping electrostatic trap of the type shown in FIG. 1, The CE injection waveforms are generated using: coupling resistors $R_{CE}$=1 MΩ for the CE 72 and $R_{DEFL}$=2.5 MΩ for the deflector electrode 65; and CE 72 and deflector electrode 65 intrinsic capacitances to ground, $C_{CE}$≈10 pF and $C_{DEFL}$≈5 pF, respectively. As a consequence, time constants of the exponentially varying electric fields (resulting from the CE injection waveforms), $R_{CE}C_{CE}$ and $R_{DEFL}C_{DEFL}$, are about 10 μs and about 12.5 μs, respectively. In view of these time constants, the initial amplitude of the varying field is reduced 5-fold, and only 20% of the remaining dynamic field could be used for trapping these higher m/z species by the time that these ions enter the region between the outer detection electrodes 75 and CE 72. Since the CE injection waveforms and resultant fields exponentially decrease in magnitude, the efficiency of trapping is further reduced proportional to the rate of change in voltage (or field strength) over time.

An explanation for why ions of low m/z ratio may be lost is now considered. The rapidly changing injection waveform applied to the CE 72 can have an induction period. This may be around 1 μs for CE 72 in a more recent design of orbital trapping mass analyzer 70, depending on the electronics used for application of this waveform. Such a long induction period may mean that ions having a low m/z ratio (less than or no greater than 100 Th) would experience low, if any, dynamic trapping field. These ions would then escape the electrostatic trap during an injection event.

It has therefore been established that, in principle, the loss of both ions with low m/z ratios and ions with high m/z ratios is due to the timing mismatch between the arrival of ions into the electrostatic trap that have been ejected from the upstream ion storage device (due to a change in the field confining the ions within that storage device), such as C-trap 50, and the dynamic capture field generated by one or more electrodes associated with the electrostatic trap, such as the deflection field and/or the injection field. This timing mismatch results from the existing approach, which starts applying the potentials to generate or adjust these ejection and capture fields at the same time. Adjustment of the time at which those fields are changed or applied can affect the ability to capture ions of a specific m/z ratio range within the electrostatic trap.

In general terms, there may be considered a method of injecting ions into an electrostatic trap, comprising: applying an ejection potential to an ion storage device, to cause ions stored in the ion storage device to be ejected towards the electrostatic trap; and applying one or more injection potentials to one or more electrodes, to cause the ions ejected from the ion storage device to be captured by the electrostatic trap. Then, the steps of applying the ejection potential and applying the one or more injection potentials are advantageously each started at respective different times. The times are beneficially selected based on desired values of mass-to-charge ratios of ions to be captured by the electrostatic trap.

In other words, the difference between the time at which the step of applying the ejection potential is started; and the time at which the step of applying the one or more injection potentials is started is preferably controlled. Specifically, the magnitude, direction or both of this difference may be selected based on the desired range of mass-to-charge ratios of ions to be captured by the electrostatic trap. The difference (effectively a delay) can be programmed on the basis of the desired m/z range, which may be user-defined and provided as an input.

This general approach can be implemented as a computer program or programmable or programed logic, configured to perform any method described herein when operated by a processor. The computer program may be stored on a computer readable medium. Also considered may be a mass spectrometer, comprising: an ion storage device, configured to receive ions for analysis (for example when a receiving potential is applied to the device), store the received ions (for example when a storing potential is applied to the device) and eject the stored ions (for example when an ejection potential, such as described above, is applied to the device); an electrostatic trap, arranged to receive the ions ejected from the ion storage device; and a controller, configured to apply potentials to parts of the mass spectrometer. The electrostatic trap is preferably of the orbital trapping type as described herein. The controller may be configured to operate in accordance with any method steps (alone or in combination) described herein. It may have structural features (one or more of: one or more inputs; one or more outputs; one or more processors; logic; and circuitry) configured to perform any one or more of these method steps. The controller may comprise a computer or processor for executing a computer program or programmable or programmed logic configured to perform any of the methods described herein. The controller may comprise trigger circuitry to start the ejection potential and one or more injection potentials. The controller may comprise a programmable delay generator and/or a clock for implementing a time difference between respective start times of applying the ejection potential to the ion storage device and applying the one or more injection potentials to the electrodes of the electrostatic trap. Information relating to values of the mass-to-charge ratios of the ions to be captured by the electrostatic trap can be input to the controller. Such input information can be utilized with the programmable delay generator and/or clock for implementing the time difference between the start times of the potentials.

Figure 2A:
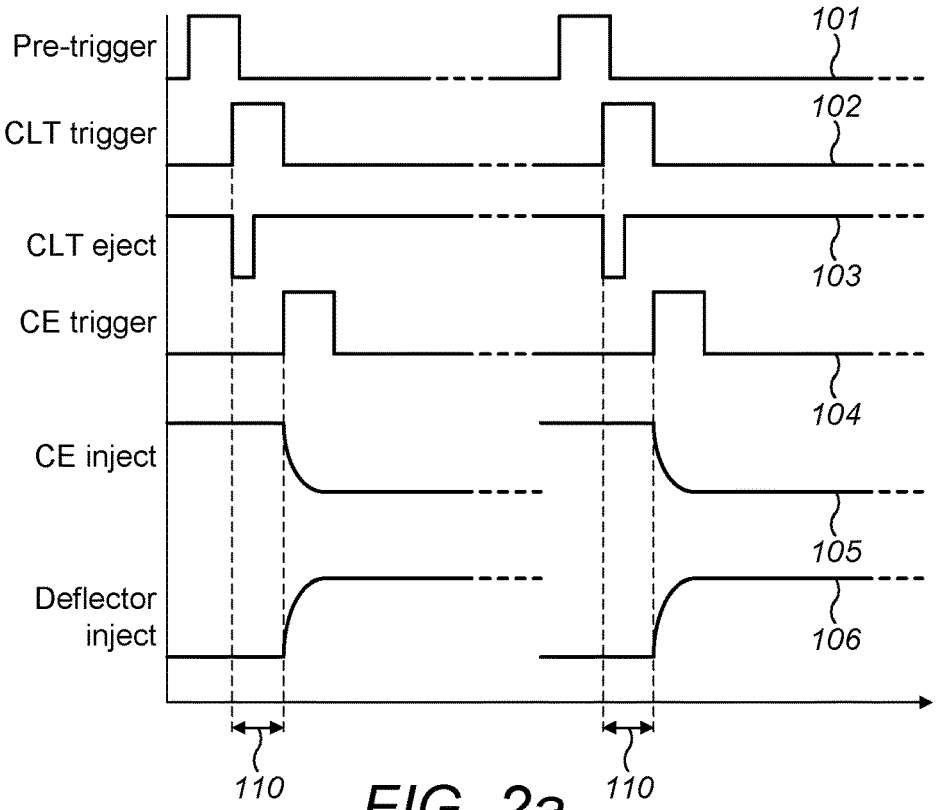
FIG. 2*a* illustrates signal waveforms for injection and ejection potentials applied to parts of the mass spectrometer of FIG. 1, in accordance with one embodiment.

The details of the selection of delays for ion injection are now considered in more depth. Referring now to FIG. 2*a*, there are illustrated signal waveforms for injection and ejection potentials applied to parts of the mass spectrometer of FIG. 1, in accordance with an embodiment. These waveforms are intended to illustrate the principle of "delayed" ion injection into the orbital trapping mass analyzer 70. The rising edge of a pre-trigger signal 101 triggers a reduction of the voltage waveform 105 applied to the CE 72 to a start voltage of, say, −3.7 kV. This takes place prior to application of a CLT pulse trigger signal 102 to the CLT 50 to start a voltage pulse 103 applied to the CLT (that is, an ejection potential applied to the CLT 50 to eject ions from the CLT 50). Next, the rising edge of an injection pulser trigger signal 104 causes the CE injection waveform 105 to ramp down further to −5 kV (from −3.7 kV), during the ion injection. Synchronously with the CE injection waveform 105, a deflector injection waveform 106 is applied to the deflector electrode 65. Note that the deflector injection waveform 106 is a positive going pulse, used to mitigate field sagging effect in the injection slot due to the negative going pulse applied to the CE 72 during injection.

As shown on the figure, the injection waveform 105 applied to the CE 72 and an injection waveform 106 applied to the deflector electrode 65, both started from the injection pulse trigger signal 104, are shifted in time by an injection delay period 110, relative to a synchronization pulse 102, which triggers application of the ejection potential 103 to the C-trap 50. The waveforms are shown as repeating, since multiple spectra are normally acquired per single experiment. The left and right-hand side waveforms of the drawing correspond to two different spectra taken at the same delay time 110 between CLT trigger 102 and CE trigger 104. The term "delayed" in this context simply refers to shifting in time, as the CE injection waveform 105 and deflector injection waveform 106 may start after the CLT ejection pulse 103 or vice versa. The waveforms 105 and 106 may be collectively referred to herein as injection waveforms. If the injection waveforms 105, 106 start after the CLT ejection pulse 103, this is referred to as a positive delay.

Figure 2B:
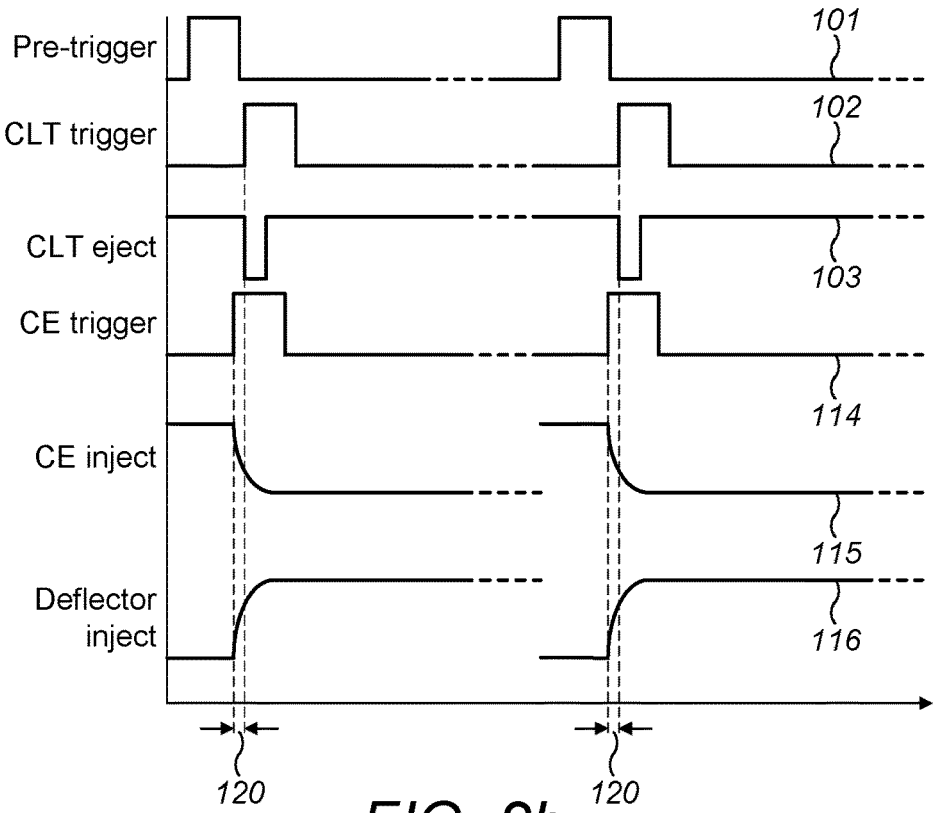
FIG. 2*b* illustrates signal waveforms for injection and ejection potentials applied to parts of the mass spectrometer of FIG. 1, in accordance with another embodiment.

If the injection waveforms start before the CLT ejection pulse 103, this is termed a negative delay. Referring next to FIG. 2*b*, there are illustrated signal waveforms for injection potentials being applied to the mass spectrometer of FIG. 1 before ejection potentials, in accordance with another embodiment. Where the waveforms of FIG. 2*b* are the same as those of FIG. 2*a*, the same reference numerals are used. For this embodiment, the injection delay period 120 is negative, because the CE trigger waveform 114 precedes the CLT trigger pulse 102. As a result, the CE injection waveform 115 and deflector injection waveform 116 start before the CLT ejection pulse 103. The magnitude of the negative injection delay period 120 shown in FIG. 2*b* is smaller than the magnitude of the positive injection delay period 110 shown in FIG. 2*a*.

It should be noted that the distance (and thus, the time-of-flight, TOF, separation) between the deflector electrode 65 and the CE 72 is much smaller than the distance (and hence TOF separation) between the CLT 50 and the deflector electrode 65. In view of this, it is simplest to trigger the deflector injection waveforms 106, 116 and CE injection waveform 105, 115 at the same time, although some shifting between these two signals may be considered in alternative approaches. For example, the CE injection waveform 105, 115 could start shortly after the deflector injection waveform 106, 116.

Figure 3:
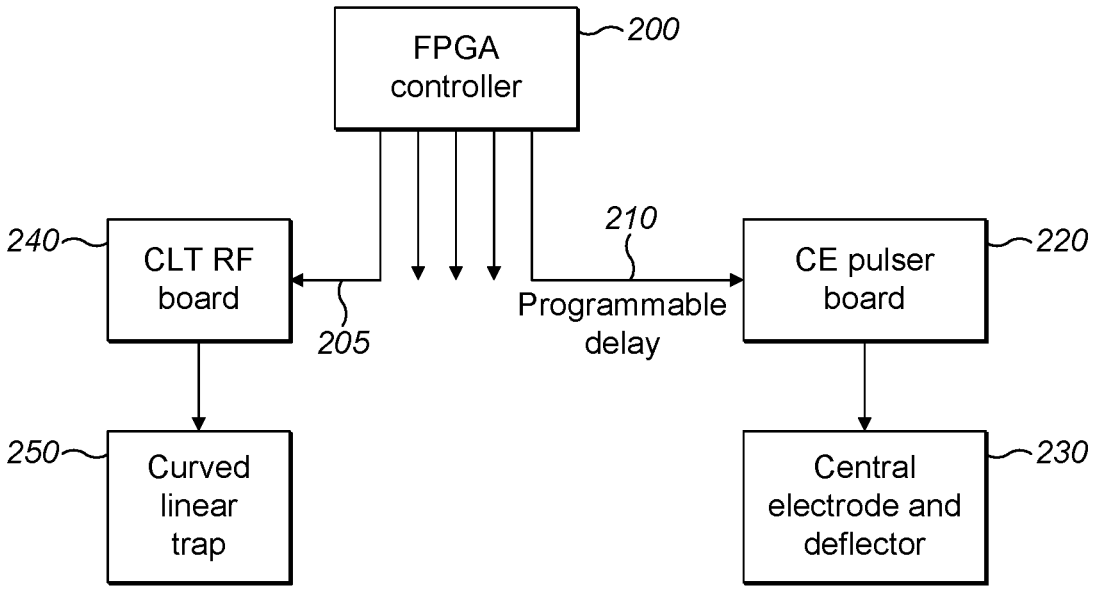
FIG. 3 depicts a schematic block diagram of a control system, in accordance with an embodiment.

A controller is therefore used to manage and synchronize signal timing appropriately. Referring next to FIG. 3, there is depicted a schematic block diagram of a control system, in accordance with an embodiment. This comprises a Field Gate Programmable Array (FPGA) controller 200, which provides outputs to: a CLT RF board 240 that applies potentials to the CLT 250; and a CE pulser board 220, supplying potentials to the central electrode and deflector 230. The CLT 250 of this drawing is equivalent to the CLT 50 of FIG. 1 and the central electrode and deflector 230 of FIG. 3 are equivalent to the CE 72 and deflector electrode 65 of the FIG. 1. The FPGA controller 200 employs a high-precision clock to generate a CLT trigger 205 and a delayed CE inject trigger 210 on separate channels. The delay of the CE inject trigger 210 is programmable at the controller 200. The CLT trigger 205 handles the logic on the CLT RF board 240 and is synchronous with ion ejection from the CLT 250, while the CE inject trigger 210 starts the injection waveforms applied to the central electrode and the deflector 230 and provides for ion injection into the electrostatic ion trap.

In this way, synchronization of the CLT trigger signal 102 and injection waveforms 105 and/or 106 is achieved using the on-board high-precision clock of FPGA controller 200. The time-shifting of the waveforms relative to one another can enable ion injection into the electrostatic field region to be triggered such that the CE injection waveform 105 is at the optimum level and the rate of change of field strength in the electrostatic trap is high for ions of the desired mass-to-charge ratio. In view of the considerations discussed above regarding the reasons for the loss of injected ions, the magnitude and/or direction of the delay (or time shift) can be selected based on the range of m/z ratios for the ions desired for capture. In the case of ions with low m/z ratios (no more or less than 100 Th), the CE injection waveform 105 (and deflector injection waveform 106) is enabled approximately 3 μs prior to switching off the RF waveform applied to the CLT 50 and applying the extraction voltage (ion purging), as counted by periods of the RF waveform applied to the CLT 50. Typically, the RF applied to the CLT 50 is at a frequency of 3 MHz, so counting 10 RF periods provides a delay of 3 μs. As above, this delay is referred to as "negative", as the CE injection potential 105 is applied before the CLT ejection pulse 103. This time shift is related to the induction period for the injection waveform applied to the CE 72, as discussed above.

In the case of ions having higher m/z ratios (at least or greater than 8000 Th), the CE injection waveform 105 (and deflector injection waveform 106) is enabled about 20 μs after switching off the RF waveform applied to the CLT 50 (ion purging) and this delay is referred to as "positive". The RF applied to the CLT 50 is switched off by the time the waveforms 105 and 106 are applied, so the positive delay is implemented by a delay generator on the FPGA controller 200. The magnitude of the time shift relates to the time of flight of ions of these m/z ratios from the CLT 50 to the entrance of the electrostatic trap 70 and the time constants of the exponentially varying potentials (or electric fields generated) at the deflector electrode 65 and/or CE 72.

Phase correction of ion signals injected into the orbital trapping mass analyzer 70 may be achieved to enable enhanced Fourier Transform and further advanced signal processing approaches, such as discussed in "Enhanced Fourier transform for Orbitrap mass spectrometry", Lange et al, International Journal of Mass Spectrometry, Volume 377, 1 Feb. 2015, Pages 338-344.

Referring to the general terms discussed above, one approach that may be considered is when the desired range of mass-to-charge ratios of ions to be captured by the electrostatic trap covers a range lower than (or no greater than) a threshold mass-to-charge ratio. In that case, the times are selected such that the step of applying the one or more injection potentials precedes the step of applying the ejection potential. Preferably, the threshold mass-to-charge ratio is 100 Th, although it may be 70, 75, 80, 90, 110, 120, 130, 140 or 150, for example.

Another approach that may be considered in addition (or alternatively) is when the desired range of mass-to-charge ratios of ions to be captured by the electrostatic trap covers a range higher than a limit mass-to-charge ratio. Then, the times may be selected such that the step of applying the ejection potential precedes the step of applying the one or more injection potentials. The limit mass-to-charge ratio is preferably 8000 Th, but may be 7000 Th, 9000 Th or 10000 Th, for instance.

The magnitude of the difference between the time at which the step of applying the ejection potential is started (the duration of the delay) and the time at which the step of applying the one or more injection potentials is started is at least 1, 2, 3, 4, 5, 10, 15, 20 or 25 μs. Additionally or alternatively, the magnitude of the difference may be no more than 1, 2, 3, 4, 5, 10, 15, 20 or 25 μs. For example, applying the one or more injection potentials may precede the step of applying the ejection potential by at least and/or no more than one of: 1, 2, 3, 4 or 5 μs, for example by a time difference in one of the ranges: 1 to 5 μs, 1 to 4 μs or 2 to 4 μs. Applying the ejection potential may precede the step of applying the one or more injection potentials by at least and/or no more than one of: 10, 15, 20 or 25 μs.

The magnitude of the difference between the time at which the step of applying the ejection potential is started and the time at which the step of applying the one or more injection potentials is started is advantageously based on one or more of: a time period associated with the ejection potential; a time period associated with the one or more injection potentials; and a time period associated with a flight time for ions between the ion storage device and the electrostatic trap. For example, the time period associated with the one or more injection potentials may be an induction period associated with an electrode to which one of the injection potentials is applied. Then, the magnitude of the difference may be at least and/or no more than 1, 2, 3, 4, 5 or 10 times an induction period associated with the one or more injection potentials (especially for ions having a mass-to-charge ratio below the threshold).

Additionally or alternatively, the magnitude of the difference may be based on (at least or greater than) one or more of: a discharge time constant associated with the one or more injection potentials; and a flight time for ions between the ion storage device and the electrostatic trap (especially for ions having a mass-to-charge ratio above the limit mass-to-charge ratio). In particular, the magnitude of the difference may be greater than (or at least) the flight time for ions between the ion storage device and the electrostatic trap but less than (or no more than) the sum of the flight time for ions between the ion storage device and the electrostatic trap and the discharge time constant associated with the one or more injection potentials. The discharge time constant associated with the one or more injection potentials may be dependent on at least one resistance and at least one capacitance associated with the electrode to which the one or more injection potentials is applied (for example, the product of the resistance and the capacitance). Additionally or alternatively, the discharge time constant may be programmable or adjustable, for instance using digital circuitry. The digital circuitry may comprise field-programmable gate array (FPGA) circuitry. The discharge time constant may be adjustable based on one or more of: a user-defined mass-to-charge range; and lowest and/or highest mass-to-charge limits. In this way, trapping and detection of higher m/z ions (for instance, at least or greater than 8000 Th) in the orbital trapping mass analyzer 70 can be performed using an injection waveform with a greater discharge time constant.

This aspect (variation of the discharge time constant) can, in some embodiments, be used alternatively to applying the ejection potential and the one or more injection potentials at different times. Thus, in another aspect, the invention provides a method of injecting ions into an electrostatic trap, comprising: applying an ejection potential to an ion storage device, to cause ions stored in the ion storage device to be ejected towards the electrostatic trap; and applying one or more injection potentials to one or more electrodes, to cause the ions ejected from the ion storage device to be captured by the electrostatic trap; and wherein a discharge time constant associated with the one or more injection potentials is adjustable based on desired values of mass-to-charge ratios of ions to be captured by the electrostatic trap, such as one or more of: a user-defined mass-to-charge range; and lowest and/or highest mass-to-charge limits.

In this way, trapping and detection of higher m/z ions (for instance, at least or greater than a first threshold level, say around 8000 Th) in the mass analyzer can be performed using an injection waveform with a relatively greater discharge time constant compared to trapping and detection of lower m/z ions (for instance, no more than or less than a second threshold, say around 100 Th) in the mass analyzer. The trapping and detection of such lower m/z ions can be performed using an injection waveform with a relatively smaller discharge time constant. The first and second thresholds are preferably different (as above), but they may be the same. Where the first and second thresholds are different, ions of m/z between the first and second thresholds may be performed using an injection waveform with the relatively greater discharge time constant, the relatively smaller discharge time constant or a discharge time constant between the relatively greater discharge time constant and the relatively smaller discharge time constant (for instance, around 10 μs).

The discharge time constant for an injection waveform applied to one or more trapping electrodes (such as applied to a central electrode of an orbital trapping electrostatic trap) is typically the same as the discharge time constant for an injection waveform applied to one or more deflection electrodes associated with the electrostatic trap (for deflecting the ions into the trap during the injection process). Alternatively, the discharge time constants may be different. The discharge time constant (or plurality of discharge time constants) may be as low as 5 μs, 10 μs, 15 μs and 25 μs. The discharge time constant (or plurality of discharge time constants) may be no greater than (or less than) 10 μs, 15 μs and 25 μs or 40 μs. For example, for higher m/z ions (greater than or at least the first threshold), the discharge time constant may be around 15 μs, 25 μs or 40 μs (or in a range between any two of these values, for example in the range 15 to 40 μs, or 15 to 25 μs, or 25 to 40 μs, or at least or greater than any of these values, for example greater than 15 μs, greater than 25 μs, or greater than 40 μs). For lower m/z ions (less or no more than the second threshold), the discharge time constant may be around 5 μs or 10 μs (or in a range between these values, that is in a range 5 to 10 μs, or less than or no more than these values, for example less than 10 μs, or less than 5 μs). Any of the features described herein with respect to this aspect, relating to the discharge time constant, may also be combined with any other aspect of this disclosure.

In the preferred embodiment, the electrostatic trap comprises a central electrode and a co-axial outer electrode, for example where the electrostatic trap is of an orbital trapping type. Then, the step of applying one or more injection potentials preferably comprises applying a trapping injection potential to the central electrode. In this case for trapping positive ions, the trapping injection potential may be a ramping potential from a first (negative) injection potential level to a second, lower (more negative) injection potential level. In the case of trapping negative ions, the trapping injection potential may be a ramping potential from a first (positive) injection potential level to a second, higher (more positive) injection potential level. Additionally or alternatively, an ion deflector may be provided between the ion storage device and the electrostatic trap. Then, the step of applying one or more injection potentials may comprise applying a deflecting injection potential to the ion deflector, to cause the ions to travel towards (optionally, focused on an entrance aperture of) the electrostatic trap. The step of applying one or more injection potentials preferably comprises applying a trapping injection potential to an electrode of the electrostatic trap. Where the electrostatic trap is an orbital trapping electrostatic trap, the trapping injection potential may be applied to a central electrode of the electrostatic trap about which the captured ions orbit. In preferred cases, both the deflecting injection potential and the trapping injection potential are applied. Then, the steps of applying the trapping injection potential and applying the deflecting injection potential are optionally started at the same time.

The step of applying the ejection potential optionally comprises reducing a magnitude of, preferably switching off, a potential applied to one or more electrodes of the ion storage device, such as an RF potential used to store ions in the device, in particular such that the ions stored in the ion storage device are ejected towards the electrostatic trap. Preferably, applying the ejection potential comprises simultaneously with reducing or switching off the potential used to store ions in the ion storage device, applying an extraction potential (preferably DC potential) to one or more electrodes of the ion storage device to extract ions from the device towards the electrostatic trap. The magnitude of the potential applied to the electrode of the ion storage device may be reduced to zero. In the preferred embodiment, the ion storage device is a curved linear trap.

In some embodiments, the step of applying an ejection potential is started by applying an ejection trigger signal to an ejection switch controlling application of the ejection potential. Additionally or alternatively, the step of applying one or more injection potentials is started by applying one or more injection trigger signals to at least one injection switch controlling application of the one of more injection potentials. In some embodiments, an RF potential with a predetermined frequency is generated, for instance as a potential for confining ions within the ion storage device. Then, the difference between respective start times of the steps of applying the ejection potential and applying the one or more injection potentials is optionally measured using the predetermined frequency of the RF potential, for example by counting periods of the RF potential. Since the RF potential is a high and stable frequency (at least 2 or 3 MHz) potential, periods of at least 1 μs can be accurately measured in this way. Additionally or alternatively, the difference between respective start times of the steps of applying the ejection potential and applying the one or more injection potentials may be measured by a clock.

The electrostatic trap is preferably operable to perform mass analysis of ions that have been captured in the electrostatic trap, for example by image current detection of ion oscillations in the trap (the frequencies of which depend mass-to-charge ratios of the ions) and signal processing (for example Fourier transformation) of the detected signal to provide a mass spectrum of the ions. In embodiments where the electrostatic trap comprises a central electrode and a co-axial outer electrode, such as in an orbital trapping mass analyzer, the co-axial outer electrode is preferably split into at least two parts that are used to detect the image current of the oscillating ions as known in the art, for example as implemented in Orbitrap® mass analyzers.

Figure 4A:
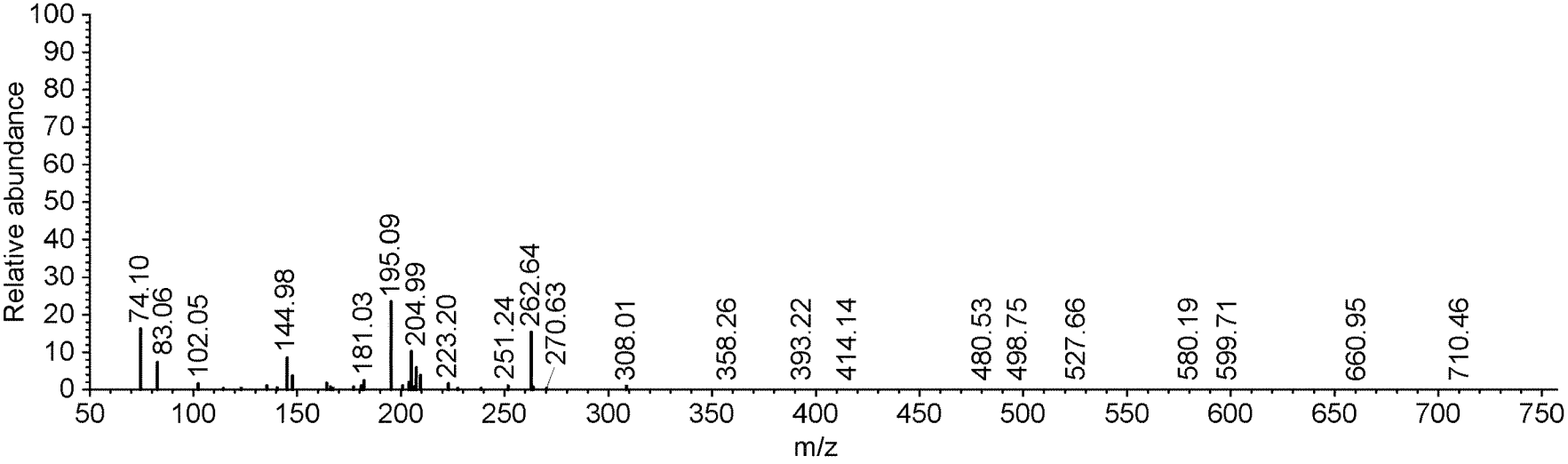
FIG. 4*a* shows example mass spectra for ion species having a low mass-to-charge ratio range, where an existing approach is used.
Figure 4B:
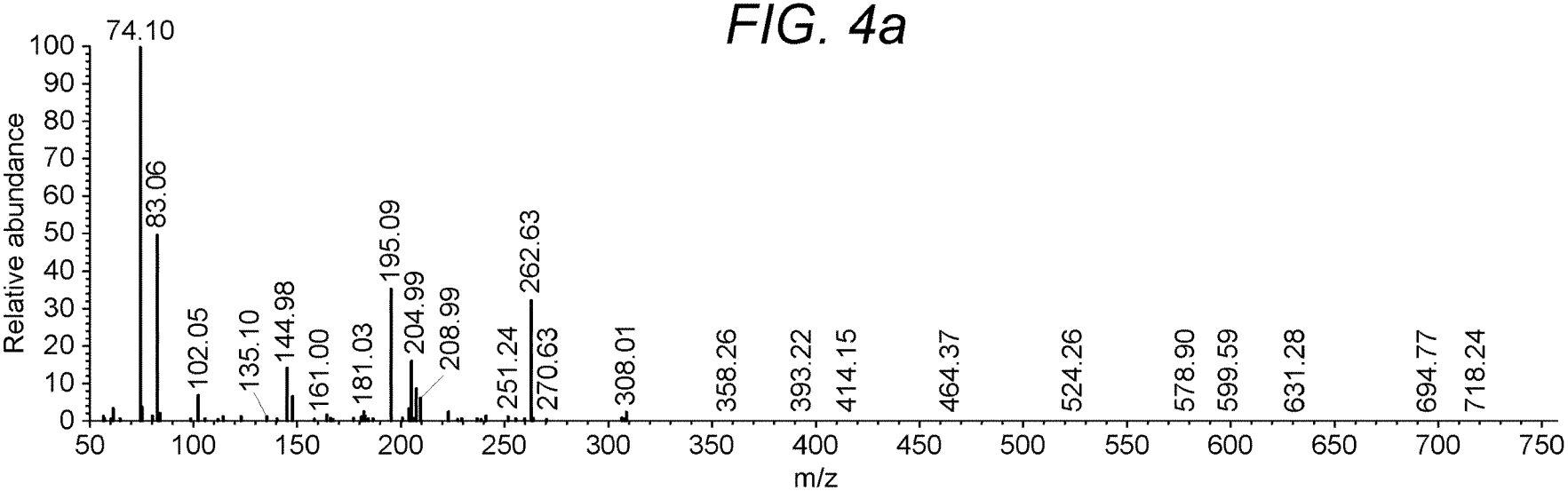
FIG. 4*b* shows example mass spectra for ion species having a low mass-to-charge ratio range, where an embodiment is used.

The advantages of the described approach will now be discussed by way of some example. Referring next to FIG. 4, there are shown example mass spectra for ion species having a low mass-to-charge ratio range, where (a) an existing approach is used and (b) an embodiment is used. These mass spectra are intended to show the efficiency of trapping ions with lower m/z ratios, using (a) a standard approach (no delay between the injection waveforms 105 and 106 and the synchronization pulse 102 applied to the C-trap 50) and (b) when a 3 μs negative delay is applied (that is, injection potentials were applied before the ejection potential is applied to the storage device). A mass spectrometer in accordance with FIG. 1 was used for these tests. A comparison of these two mass spectra shows that the use of a negative delay between the CLT synchronization pulse 102 and CE injection waveforms 105 and 106 results in a significant signal-to-noise improvement for the lower mass part of the spectrum and in particular, a signal-to-noise improvement by a factor of 5 for immonium ions at m/z 74.10.

Figure 5A:
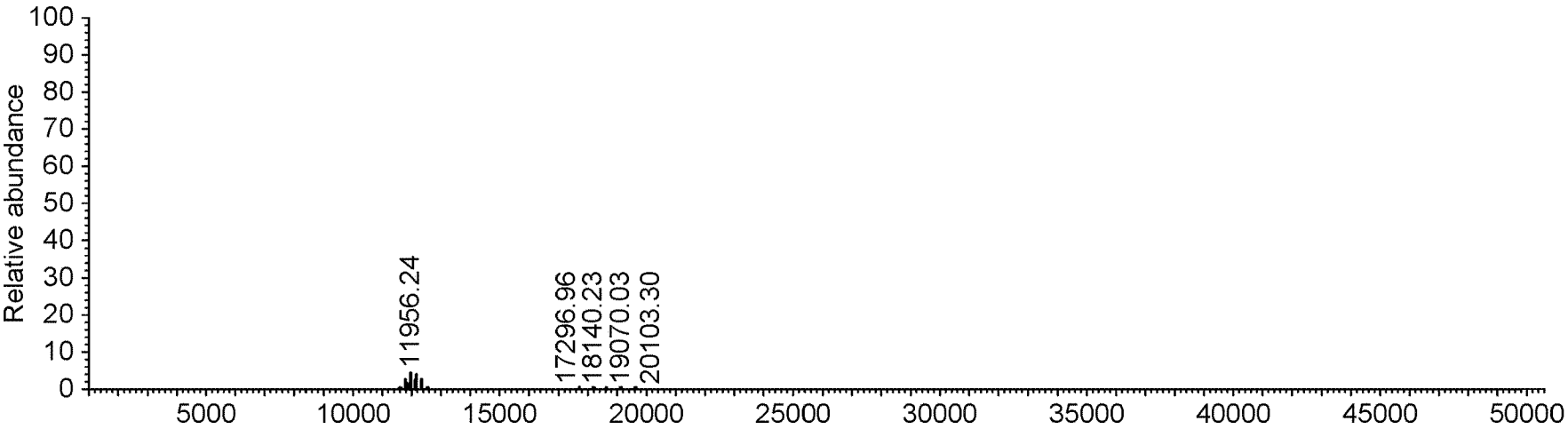
FIG. 5*a* shows first example mass spectra for ion species having a high mass-to-charge ratio range, where an existing approach is used.
Figure 5B:
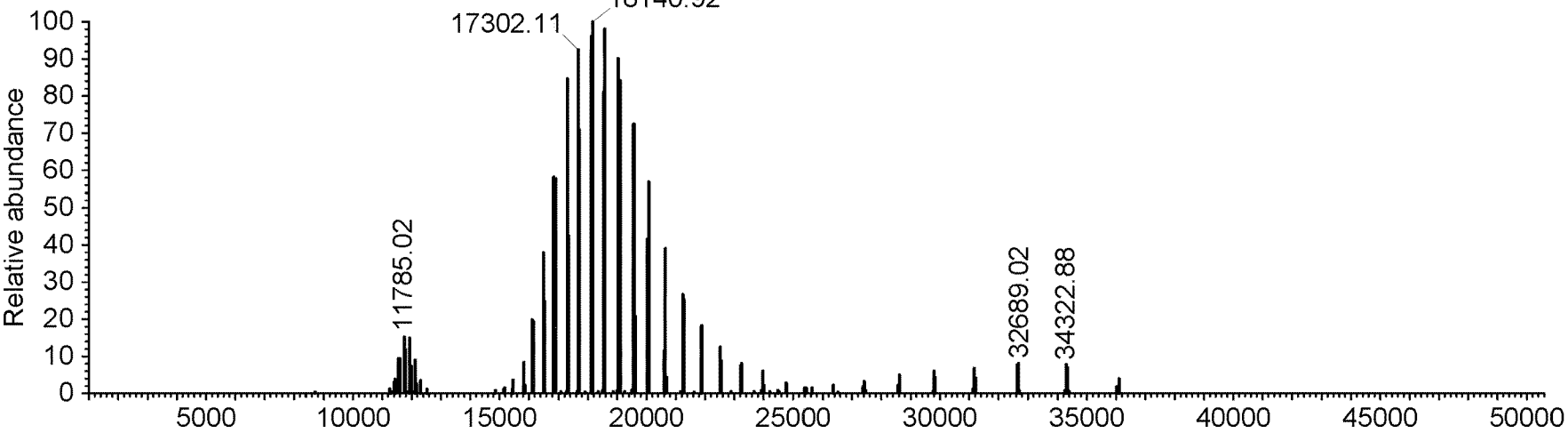
FIG. 5*b* shows first example mass spectra for ion species having a high mass-to-charge ratio range, where an embodiment is used in accordance with a first approach.
Figure 6A:
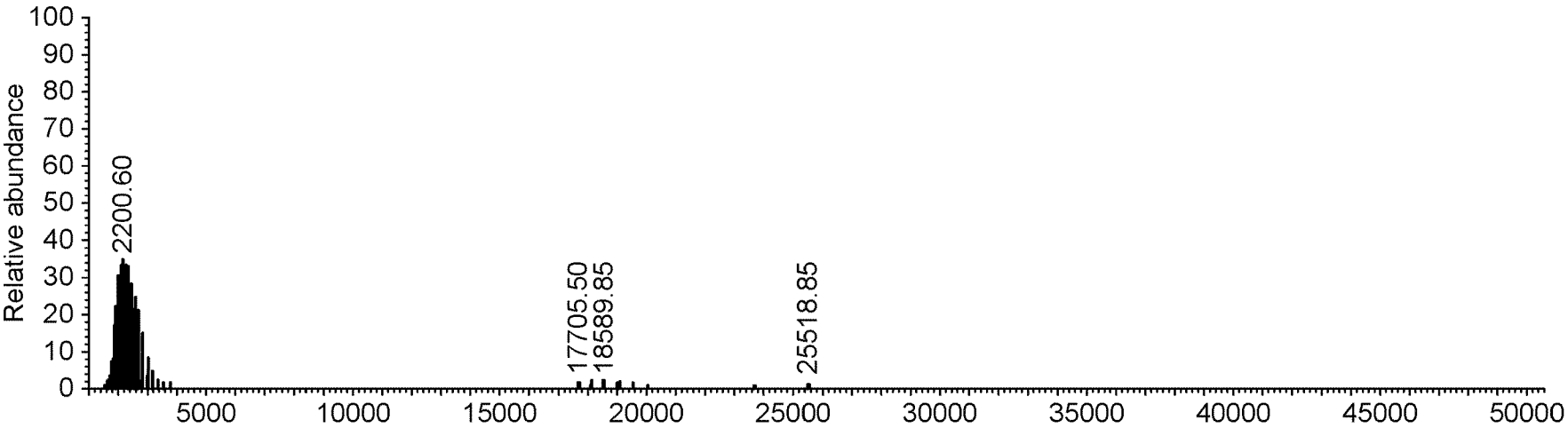
FIG. 6*a* shows second example mass spectra for ion species having a high mass-to-charge ratio range, where an existing approach is used.
Figure 6B:
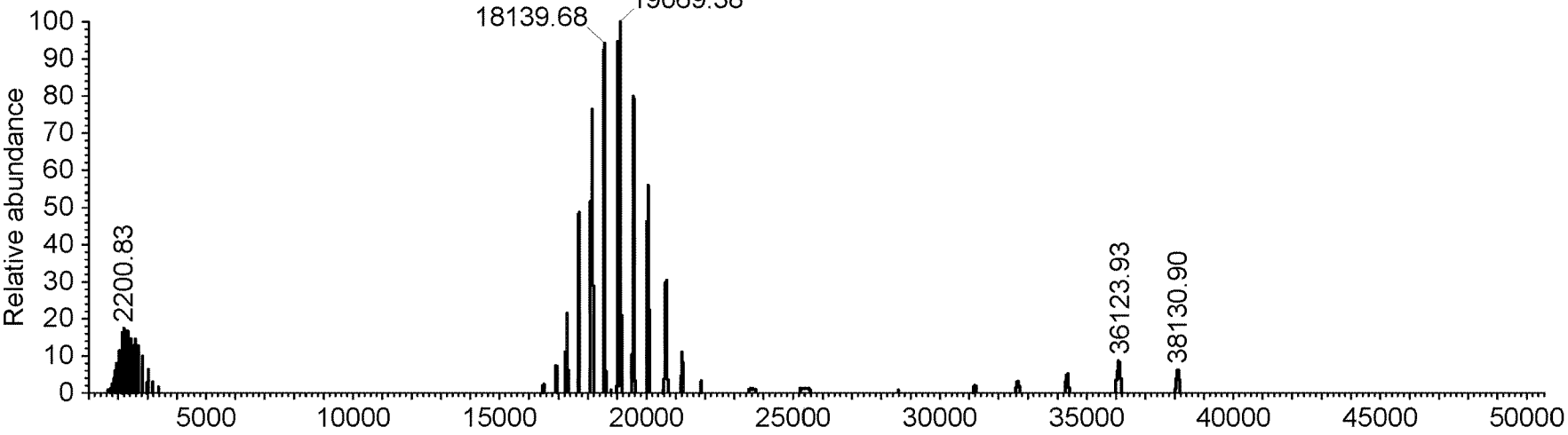
FIG. 6*b* shows second example mass spectra for ion species having a high mass-to-charge ratio range, where an embodiment is used in accordance with a second approach.

Referring next to FIGS. 5 and 6, there are shown example mass spectra for ion species having a high mass-to-charge ratio range, where (a) an existing approach is used and (b) an embodiment is used. These figures are intended to show signal-to-noise improvement for ions with higher m/z ratios, due to introduction of a programmable delay between the CLT synchronization pulse 102 and injection waveforms 105 and 106. These experiments were performed in native MS mode of a mass spectrometer in accordance with FIG. 1, using GroEL protein complex (molecular weight 801 kDa), which encompasses two non-covalently bound heptameric rings, resulting in formation of a 14-mer complex. This protein complex was further collisionally activated in the HCD cell 80 to produce counter complexes of both 13-mer and 12-mer species. A direct voltage bias of −200 V was applied in the region of the HCD cell 80. In FIG. 5, a pressure of $1.4\times10^{-4}$ mbar ($1.4\times10^{-2}$ Pa) was used in the C-trap 50 and in FIG. 6 a pressure of $7.7\times10^{-5}$ mbar ($7.7\times10^{-3}$ Pa) was used in the C-trap 50. In both FIG. 5 and FIG. 6, the first mass spectrum (a) was generated using an existing, standard approach (no delay between the injection waveforms 103 and 104 and the synchronization pulse 105 applied to the C-trap 50). In FIG. 5, the second mass spectrum (b) was generated using a 25 μs positive delay between the CLT synchronization pulse 102 and the injection waveforms 105 and 106. In FIG. 6, the second mass spectrum (b) was generated using a 20 μs positive delay between the CLT synchronization pulse 102 and the injection waveforms 105 and 106.

In FIG. 5, the precursor signal is observed at an m/z ratio of 12K. Charge state envelopes of 13-mer and 12-mer counter complexes are observed at m/z ratios of 18K and 34K, respectively. In FIG. 6, the ejected subunit signal is detected at an m/z ratio of 2200, with a lower signal-to-noise ratio. Charge state envelopes of 13-mer and 12-mer counter complexes are again observed at m/z ratios of 18K and 34K, respectively. In both cases, the signal-to-noise ratio of the charge state envelopes of the 13-mer counter complex is significantly improved, as evidenced by comparing against 13-mer signals in the mass spectra in FIGS. 5 (*a*) and 6(*a*) respectively. Moreover, using the "delayed" ion injection approach, the signals of the charge state envelopes of 12-mer counter complex were acquired at a signal-to-noise ratio exceeding 50. This is again observable in FIGS. 5(*b*) and 6(*b*). These high m/z species could not be detected under standard conditions, as shown in FIGS. 5(*a*) and 6(*a*).

It can be seen from the above description that the invention advantageously can enable highly efficient detection of both lower m/z (for example less than or no more than 100 Th or 80 Th) and higher m/z (for example at least or greater than 8,000, 12,000, 16,000 or 20,000 Th) ions using an electrostatic trap. Thus, an electrostatic trap, such as an Orbitrap® mass analyzer for example, can be employed efficiently for mass spectrometry of small molecules and large macromolecular assemblies. Higher signal-to-noise ratios of detection can be achieved than with prior art methods. The ion injection can be tuned and optimized for the mass range of ions that it is desired to captured and/or analyze. For example, a programmable delay between starting the ejection potential applied to the ion storage device and the one or more injection potentials applied to the electrostatic trap can be used, which can be responsive to a user-defined m/z range. The ratio of highest and lower m/z in a spectrum can be in the range of 40:1.

Although a specific embodiment has been described, the skilled person will appreciate that various modifications and alternations are possible. In particular, different configurations of mass spectrometer, with different types of electrostatic trap and/or ion storage device may be used. The threshold or limit for what constitutes a low and/or high m/z range may be varied depending on the types of electrostatic trap and/or ion storage device. Also, the specific signals used to effect ejection from the ion storage device and/or injection to the electrostatic trap may change. The magnitude of the delay between the ejection and injection waveforms being applied may be varied depending on a range of factors, including the values of m/z ratios of ions desired to be captured in the electrostatic trap. The electrostatic trap is preferably operated as a mass analyzer, but this need not be so and it may be used for other purposes in addition or as an alternative.

It will therefore be appreciated that variations to the foregoing embodiments of the invention can be made while still falling within the scope of the invention. Each feature disclosed in this specification, unless stated otherwise, may be replaced by alternative features serving the same, equivalent or similar purpose. Thus, unless stated otherwise, each feature disclosed is one example only of a generic series of equivalent or similar features.

As used herein, including in the claims, unless the context indicates otherwise, singular forms of the terms herein are to be construed as including the plural form and vice versa. For instance, unless the context indicates otherwise, a singular reference herein including in the claims, such as "a" or "an" (such as an analogue to digital convertor) means "one or more" (for instance, one or more analogue to digital convertor). Throughout the description and claims of this disclosure, the words "comprise", "including", "having" and "contain" and variations of the words, for example "comprising" and "comprises" or similar, mean "including but not limited to", and are not intended to (and do not) exclude other components.

The use of any and all examples, or exemplary language ("for instance", "such as", "for example" and like language) provided herein, is intended merely to better illustrate the invention and does not indicate a limitation on the scope of the invention unless otherwise claimed. No language in the specification should be construed as indicating any non-claimed element as essential to the practice of the invention.

Any steps described in this specification may be performed in any order or simultaneously unless stated or the context requires otherwise.

All of the features disclosed in this specification may be combined in any combination, except combinations where at least some of such features and/or steps are mutually exclusive. In particular, the preferred features of the invention are applicable to all aspects of the invention and may be used in any combination. Likewise, features described in non-essential combinations may be used separately (not in combination).

The invention claimed is:

1. A method of injecting ions into an electrostatic trap, comprising:

applying an ejection potential to an ion storage device, to cause ions stored in the ion storage device to be ejected towards the electrostatic trap; and applying one or more injection potentials to an electrode associated with the electrostatic trap, to cause the ions ejected from the ion storage device to be captured by the electrostatic trap; and wherein the steps of applying the ejection potential and applying the one or more injection potentials are each started at respective different times, the difference in times being selected based on desired values of mass-to-charge ratios of ions to be captured by the electrostatic trap; and wherein an RF potential with a predetermined frequency is generated and the difference between respective start times of the steps of applying the ejection potential and applying the one or more injection potentials is measured using the predetermined frequency of the RF potential.

2. The method of claim 1, wherein the electrostatic trap is an orbital electrostatic trap.

3. The method of claim 2, wherein applying the one or more injection potentials to the electrode associated with the electrostatic trap comprises applying one or more injection potentials to a central electrode of the orbital electrostatic trap.

4. The method of claim 3, wherein applying the one or more injection potentials to the electrode associated with the electrostatic trap further comprises applying one or more injection potentials to a deflector electrode associated with the orbital electrostatic trap.

5. The method of claim 4, wherein the injection potentials are applied synchronously to the central electrode of the orbital electrostatic trap and the deflector electrode associated with the orbital electrostatic trap.

6. The method of claim 4, wherein an ion deflector comprising the deflector electrode is provided between the ion storage device and the orbital electrostatic trap and wherein the step of applying injection potentials comprises applying a deflecting injection potential to the ion deflector, to cause the ions to travel towards the orbital electrostatic trap.

7. The method of claim 1, wherein the difference between respective start times of the steps of applying the ejection potential and applying the one or more injection potentials is measured by counting periods of the RF potential.

8. The method of claim 1, wherein the RF potential has a frequency of at least 2 MHz.

9. The method of claim 1, wherein the RF potential is a potential for confining ions within the ion storage device.

10. The method of claim 1, wherein one or both of a magnitude and a direction of the difference between the time at which the step of applying the ejection potential is started and the time at which the step of applying the injection potentials is started is or are selected based on the desired values of mass-to-charge ratios of ions to be captured by the electrostatic trap.

11. The method of claim 1, wherein the desired values of mass-to-charge ratios of ions to be captured by the electrostatic trap includes values lower than a threshold mass-to-charge ratio, the difference in times being selected such that the start of the step of applying the one or more injection potentials precedes the start of the step of applying the ejection potential.

12. The method of claim 11, wherein the threshold mass-to-charge ratio is 100 Thomsons.

13. The method of claim 1, wherein the desired values of mass-to-charge ratios of ions to be captured by the electrostatic trap includes values higher than a limit mass-to-charge ratio, the difference in times being selected such that start of the step of applying the ejection potential precedes the start of the step of applying the one or more injection potentials.

14. The method of claim 13, wherein the limit mass-to-charge ratio is 8000 Thomsons.

15. The method of claim 1, wherein the magnitude of the difference between the time at which the step of applying the ejection potential is started and the time at which the step of applying the one or more injection potentials is started is at least 3 μs.

16. The method of claim 1, wherein the magnitude of the difference between the time at which the step of applying the ejection potential is started and the time at which the step of applying the one or more injection potentials is started is based on one or more of: a time period associated with the ejection potential; a time period associated with the one or more injection potentials; and a time period associated with a flight time for ions between the ion storage device and the electrostatic trap.

17. The method of claim 16, wherein the magnitude of the difference is at least 3 times an induction period associated with the injection potentials.

18. The method of claim 16, wherein the magnitude of the difference is based on at least one of: a discharge time constant associated with the injection potentials; and a flight time for ions between the ion storage device and the electrostatic trap.

19. The method of claim 18, wherein the magnitude of the difference is greater than the flight time for ions between the ion storage device and the electrostatic trap but less than the sum of the flight time for ions between the ion storage device and the electrostatic trap and the discharge time constant associated with the synchronous injection potentials.

20. The method of claim 18, wherein the discharge time constant associated with the injection potentials is dependent on at least one respective resistance and at least one respective capacitance associated with each of the central electrode and the deflector electrode to which the synchronous injection potentials are applied.

21. The method of claim 18, wherein the discharge time constant associated with the injection waveforms is programmable or adjustable using digital circuitry.

22. The method of claim 3, wherein the orbital electrostatic trap comprises the central electrode and a co-axial outer electrode and wherein the step of applying injection potentials comprises applying a trapping injection potential to the central electrode.

23. The method of claim 22, wherein the trapping injection potential is a ramping potential from a first injection potential level to a second, lower injection potential level.

24. The method of claim 1, wherein the step of applying the ejection potential comprises reducing a magnitude of a potential applied to one or more electrodes of the ion storage device, such that the ions stored in the ion storage device are ejected towards the electrostatic trap.

25. The method of claim 24, wherein the step of applying the ejection potential comprises switching off an RF potential applied to one or more electrodes of the ion storage device, and applying a DC extraction potential to one or more electrodes of the ion storage device, such that the ions stored in the ion storage device are ejected towards the electrostatic trap.

26. The method of claim 1, wherein the ion storage device is a curved linear trap.

27. The method of claim 1, wherein the step of applying an ejection potential is started by applying an ejection trigger signal to an ejection switch controlling application of the ejection potential and/or wherein the step of applying one or more injection potentials is started by applying one or more injection trigger signals to at least one injection switch controlling application of the injection potentials.

28. A mass spectrometer, comprising:

an ion storage device, configured to receive ions for analysis, store the received ions and eject the stored ions;

an electrostatic trap, being arranged to receive the ions ejected from the ion storage device; and a controller, coupled to the ion storage device and to the electrostatic trap and configured to perform the following steps:

applying an ejection potential to the ion storage device, to cause ions stored in the ion storage device to be ejected towards the electrostatic trap; and applying one or more injection potentials to an electrode associated with the electrostatic trap, to cause the ions ejected from the ion storage device to be captured by the electrostatic trap; and wherein the steps of applying the ejection potential and applying the one or more injection potentials are each started at respective different times, the difference in times being selected based on desired values of mass-to-charge ratios of ions to be captured by the electrostatic trap; and wherein an RF potential with a predetermined frequency is generated and the difference between respective start times of the steps of applying the ejection potential and applying the one or more injection potentials is measured using the predetermined frequency of the RF potential.

* * * * *